US005525752A

United States Patent [19]

Izumizaki et al.

[11] Patent Number: 5,525,752

[45] Date of Patent: Jun. 11, 1996

[54] DEVELOPING APPARATUS

[75] Inventors: Masami Izumizaki, Yokohama; Koji Amemiya, Tokyo; Yuji Sakemi, Inagi; Shigeru Ohki, Yokohama; Kunihiko Kitayama, Kawasaki, all of Japan

[73] Assignee: Canon Kabushiki Kaisha, Tokyo, Japan

[21] Appl. No.: 186,131

[22] Filed: Jan. 25, 1994

[30] Foreign Application Priority Data

Jan. 25, 1993 [JP] Japan ..... 5-027137
Apr. 19, 1993 [JP] Japan ..... 5-115376

[51] Int. Cl.[6] ..... G03G 15/09

[52] U.S. Cl. ..... 118/658; 355/251

[58] Field of Search ..... 355/251, 253; 118/658, 656; 430/108, 111

[56] References Cited

U.S. PATENT DOCUMENTS

| | | | |
|---|---|---|---|
| 4,436,055 | 3/1984 | Yamashita et al. | 118/658 |
| 4,777,107 | 10/1988 | Kurematsu et al. | 130/122 |
| 4,800,412 | 1/1989 | Ueda | 355/251 |
| 4,844,008 | 7/1989 | Sakemi et al. | 118/658 |
| 4,851,872 | 7/1989 | Murasaki et al. | 355/253 |
| 4,898,801 | 2/1990 | Tachibana et al. | 430/108 X |
| 4,940,014 | 7/1990 | Saijo et al. | 118/658 |
| 4,959,692 | 9/1990 | Hayashi et al. | 355/253 |
| 5,044,313 | 9/1991 | Yuge et al. | 118/658 |
| 5,177,536 | 1/1993 | Watanabe et al. | 355/251 |
| 5,212,525 | 5/1993 | Noami et al. | 355/251 |
| 5,239,343 | 8/1993 | Sakemi et al. | 355/253 |
| 5,260,160 | 11/1993 | Aoki et al. | 430/111 X |
| 5,287,148 | 2/1994 | Sakemi et al. | 355/245 |
| 5,290,652 | 3/1994 | Harakawa et al. | 430/108 X |
| 5,310,617 | 5/1994 | Taguchi et al. | 430/108 X |

*Primary Examiner*—Robert Beatty
*Attorney, Agent, or Firm*—Fitzpatrick, Cella, Harper & Scinto

[57] ABSTRACT

A developing device for developing an electrostatic latent image includes a rotatable developer carrying member for carrying a developer composed of toner particles and magnetic carrier particles, wherein the developer carrying member rotates through a supply position where the developer is supplied to a surface of the developer carrying member, a regulating position where a regulating member for regulating a thickness of a layer of the developer on the surface is disposed, a developing position where the electrostatic latent image is developed, and a removing position for removing the developer remaining on the surface after a developing operation, in the order named. A stationary magnet is disposed in the developer carrying member. The magnet includes a developing magnetic pole for forming a magnetic field at the developing position, and a plurality of conveying magnetic poles disposed between the supply position and the regulating position, wherein a peak of magnetic flux density of each of the conveying magnetic poles is 10–49% of a peak of the magnetic flux density of the developing magnetic pole.

5 Claims, 3 Drawing Sheets

DEVELOPING APPARATUS

FIELD OF THE INVENTION AND RELATED ART

The present invention relates to a developing device for developing an electrostatic latent image using a developer including toner particles and magnetic carrier particles.

FIG. 1 illustrates a developing device usable with the present invention.

In FIG. 1, a developing device 9 comprises a container 8 for accommodating a two component developer 7 including mixed non-magnetic property toner particles and magnetic property carrier particles. A first stirring chamber 13 and a second stirring chamber 14 are provided in the container 8. A partition wall 6 is provided between second chamber 14 and first chamber 13. The partition wall 6 is provided with a developer opening at the opposite longitudinal end portions (perpendicular to the sheet of the drawing), and the developer circulates between first chamber 13 and second chamber 14.

As a means for moving the developer in the longitudinal direction (perpendicular to the sheet of the drawing) of the sleeve which will be described hereinafter, and for stirring it, the first chamber 13 and the second chamber 14 are provided with respective screws 11, 12 rotatable in the direction indicated by an arrow. The developer within the first chamber 13 is moved in the longitudinal direction by rotation of the above described screw 11, while being stirred, and it enters the second chamber 14 through one of the above-mentioned openings. The developer within the second chamber 14 is moved in the longitudinal direction by rotation of the screw 12, while being stirred, and it enters the first chamber 13 through the above-mentioned another opening. The direction of the movement of the developer by screw 11 is opposite the direction of the movement of the developer by screw 12.

The toner and the carrier is mixed uniformly by the above-described stirring, and the toner obtains the sufficient friction charge of a polarity for developing the latent image by the friction with the carrier. In addition, the toner is supplied from unshown toner supply means to the second chamber 14. In the opening part of the container 8, there is disposed, as a developer carrying member, a non-magnetic property sleeve 3 composed of stainless steel, aluminum or the like. This sleeve 3 rotates in the direction indicated by an arrow. A stationary magnet 10 is disposed inside the sleeve 3. This magnet 10 has a plurality of magnetic poles as shown in FIG. 1. In this example, two N-poles N1 and N2 and three S-poles S1, S2 and S3 are provided. In the rotation path of the above-described sleeve 3, there are a supply position 31, a confinement position 32, a developing position 33 and a removal position 34. The sleeve 3 rotates through the above-described respective positions in the order named.

The electrophotographic photosensitive member 4, which forms an image carrying member, passes also through the developing position 33. The toner is deposited onto an electrostatic latent image on the photosensitive member 4 at this position 33, so that the latent image is developed. The first magnetic pole N1 is a developing magnetic pole for forming a magnetic field at this developing position 33. A magnetic brush of the developer is formed by this magnetic field and is contacted to the photosensitive member 4.

In order to improve the developing efficiency, the sleeve 3 is supplied with an oscillating bias voltage 15. An AC biased DC is usable as the oscillating bias voltage. However, a DC bias voltage may be applied to the sleeve 3. The second, the third, the fourth and the fifth magnetic pole S2, N2, S2, S1 function as transportation magnetic poles for attracting magnetically the developer on the sleeve 3, so that the developer can be transported by rotation of the sleeve.

The second magnetic pole S2 takes up the developer within the first chamber 13 by the magnetic field thereof, and the developer taken up is deposited magnetically on the sleeve 3 surface in the supply position 31. The developer magnetically deposited on the surface of the sleeve 3 at the supply position 31 is transported to the regulating position 32 by the rotation of the sleeve 3.

The developer layer thickness regulating member 2 is arranged opposite the sleeve 3 at the regulating position 32. This member 2 may be in the form of a doctor blade of a non-magnetic material such as aluminum. The gap between the blade 2 and the sleeve 3 is preferably 600–1300 μm from the standpoint of forming a thin layer of the developer.

The blade 2 regulates the thickness of the developer layer transported to the developing position 33.

The third magnetic pole N2 forms a magnetic field at the regulating position 32, so that the blade 2 can smoothly regulate the thickness of the developer layer.

The developer blocked from passing through the gap between the blade 2 and the sleeve 3 at the regulating position 32 reverses direction and is moved substantially in the opposite direction from the rotational direction of the sleeve 3, and falls into the first chamber by the function of the gravity.

The above-described reversing movement of the developer is guided by the developer guiding surface 1' of the guiding member 1.

The fourth magnetic pole S3 is upstream of the second magnetic pole S2 with respect to the rotational direction of the sleeve 3, and is adjacent the second magnetic pole S2.

The fourth magnetic pole S3 has the same polarity as the second magnetic pole S2. Accordingly, a repelling magnetic field is formed between the magnetic poles S2 and S3. The developer which remains on the sleeve 3 after the developing operation, and which returns into the container 8, is removed from the sleeve 3 at the removal position 34 by this repelling magnetic field, and falls into the first chamber 13.

A fifth magnetic pole S1 is positioned between the regulating position 32 and the developing position, and contributes to stably transport the developer layer passed through the regulating position 32 to the developing position 33. In the case, for example, that the distance between the regulating position 32 and the developing position 33 is short, the fifth magnetic pole S1 is unnecessary.

In any case, in the device using the two component developer, the developer deteriorates with repetition of the operation of the device.

On the surface of the sleeve 3 from the supply position 31 to the regulating position 32, a relatively thick developer layer exists.

To the developer adjacent to the sleeve 3 surface at the bottommost portion of this developer layer, the magnetic pressure toward the sleeve center by the developer layer being attracted by the magnetic force of the magnetic poles S2 and N2, is applied.

It has been found that a strong stress is applied to the toner particles and the magnetic property carrier particles, adjacent to the sleeve surface by the function of this pressure, with the result that carrier deterioration in which the resin component of the toner is fused on the carrier particle surface is promoted.

It also has been found that when the toner powder contains silica fine particles and/or titanium oxide particles or the like for improving flowability, toner deterioration of the toner having such material is promoted.

When such carrier deterioration and/or toner deterioration occurs, the toner cannot obtain sufficient friction charging, with the result that the image quality of the developing image tends to deteriorate, and fog tends to occur in the background part of the developed image.

SUMMARY OF THE INVENTION

Accordingly, the object of the present invention is to provide a developing device which can restrain the deterioration speed of the developer.

Another object of the present invention is to provide a developing device which can form a developing image of satisfactory image quality over a long period, wherein the deterioration speed of the developer is restrained.

A further object of the present invention is to provide developing device which can restrain the fog or the toner scattering over a long period, wherein the deterioration speed of the developer is restrained.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
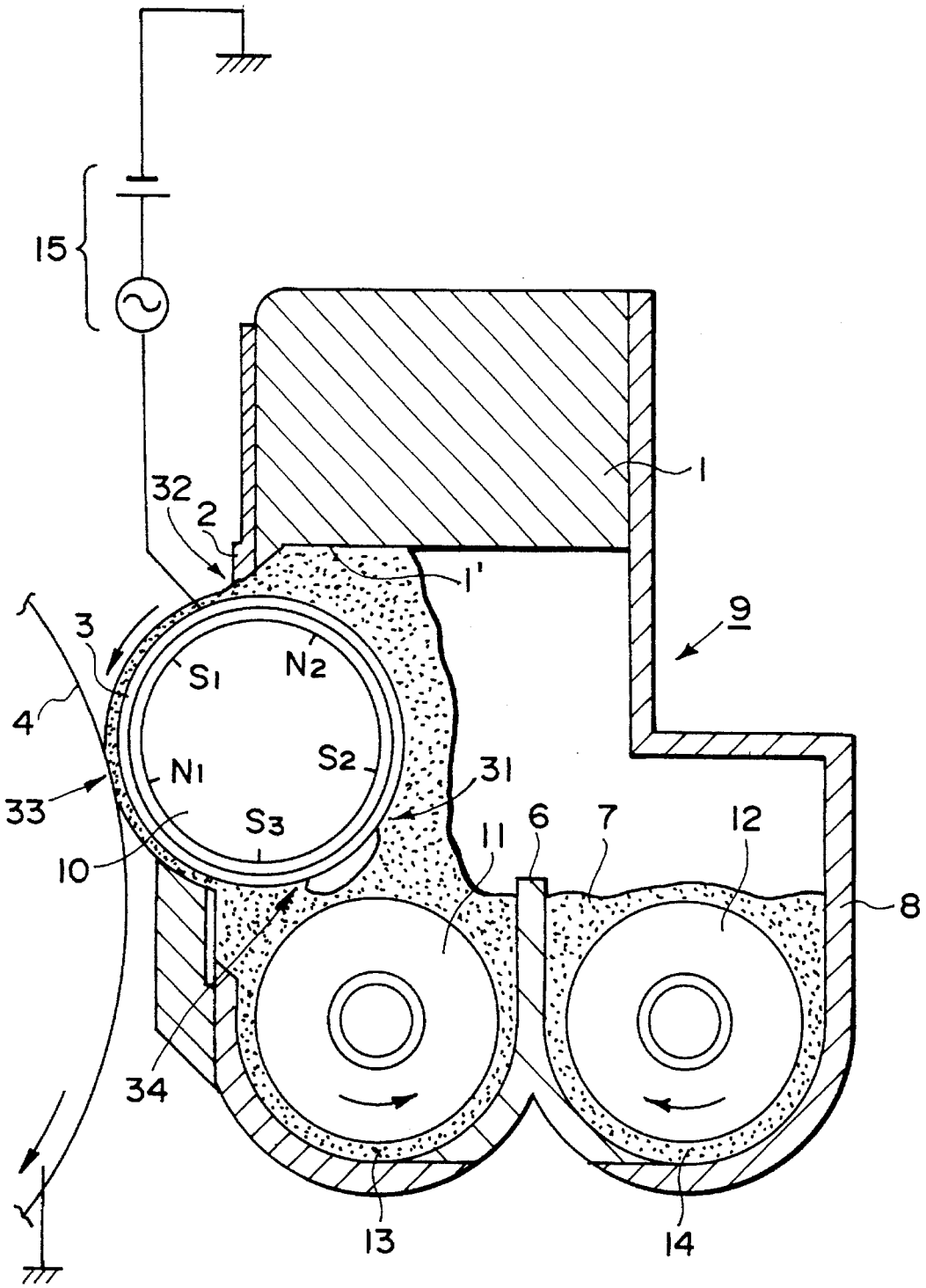
FIG. 1 is an illustration of an example of a developing device usable with the present invention.

FIG. 1 is an illustration of an embodiment of the present invention.

The arrangement and the function of each member are as described above. However, as to the magnetic poles S2, N2 which are the cause of the developer deterioration, the strength of the magnetic poles are selected so as to prevent developer deterioration over the long term.

For the magnet roller 10 shown in FIG. 1, 18 magnet rollers (a to r) having different magnetic flux densities at the first, second and third magnetic poles N1, S2 and N2 are provided (See Table 1). For the respective magnet rollers, the developer conveying property in the developing apparatus 10, and the image deterioration after 100,000 copy operations on A4 size sheets with print ratio of 10%, have been evaluated. The results are shown in Table 1.

TABLE 1

| Magnets | Flux density (Gauss) $N_1$ | $N_2$ | $S_2$ | Converying property | Image deteriora-tion | Total deteriora-tion | $N_2/N_1$ (%) | $S_2/N_1$ (%) |
|---|---|---|---|---|---|---|---|---|
| a | 1200 | 800 | 800 | Y | N | N | 67 | 67 |
| b | 1200 | 800 | 650 | Y | N | N | 67 | 54 |
| c | 1200 | 600 | 800 | Y | N | N | 50 | 67 |
| d | 1200 | 600 | 600 | Y | N | N | 50 | 50 |
| e | 1200 | 400 | 600 | Y | N | N | 33 | 50 |
| f | 1200 | 590 | 590 | Y | Y | Y | 49 | 49 |
| g | 1200 | 500 | 400 | Y | Y | Y | 42 | 33 |
| h | 1200 | 400 | 400 | Y | Y | Y | 33 | 33 |
| i | 1200 | 120 | 120 | F | Y | Y | 10 | 10 |
| j | 1200 | 100 | 100 | N | Y | N | 8 | 8 |
| k | 1000 | 600 | 600 | Y | N | N | 60 | 60 |
| l | 1000 | 600 | 550 | Y | N | N | 60 | 55 |
| m | 1000 | 500 | 500 | Y | N | N | 50 | 50 |
| n | 1000 | 300 | 250 | Y | Y | Y | 30 | 25 |
| o | 800 | 500 | 450 | Y | N | N | 63 | 56 |
| p | 800 | 400 | 400 | Y | N | N | 50 | 50 |
| q | 800 | 120 | 120 | F | Y | Y | 15 | 15 |
| r | 800 | 70 | 70 | N | Y | N | 9 | 9 |

In this specification, the magnetic flux density of a magnetic pole is a peak on a surface of the sleeve (developer carrying member) of the magnetic flux density distribution of the magnetic field provided by the magnetic pole.

In Table 1, N2/N1 is 100×(magnetic flux density of the magnetic pole N2)/(the magnetic flux density of the magnetic pole N1), and S2/N1 is 100×(magnetic flux density of the magnetic pole S2)/(magnetic flux density of magnetic pole N1).

In Table 1, "Y" means good, "F" is fairly good, and "N" means no good.

As will be understood from Table 1, if the magnetic flux densities of the second magnetic pole S2 and the third magnetic pole N2 are not less than 10% of the magnetic flux density of the first magnetic pole N1 and are not more than 49% thereof, then the developer conveying property is good, and image deterioration is prevented. In other words, the developer deterioration can be prevented for a long period of time.

A description now will be made as to the developer usable with the present invention. In this embodiment, the developer is a two component developer comprising carrier particles and toner particles. The carrier used in this invention preferably has an average particle size less than the conventional carrier particles, and the grain distribution thereof is sharp. The number of contacts between the carrier and toner particles is increased because of the small particle size, and the rate of toner charging is increased, so that the non-charged toner is not developed even if the supply of the developer is increased. In addition, the quick rate of charging, is effective to prevent an increase in the foggy background and the scattering of the toner due to the non-charged toner under a high humidity condition. Therefore, by combining the toner which will be described hereinafter, with a developer not resulting in scattering or foggy background with the less influence by the humidity change, even large area originals may be continuously copied.

Because of the sharp grain distribution of the carrier particles, the phenomenon that fine carrier particles are transferred onto the photosensitive drum together with the toner during developing operation, can be avoided. This phenomenon conventionally occurs in the case of using the small size carrier particles. Therefore, the deterioration of the image quality due to insufficient charging by coarse carrier particles conventionally occurs.

The weight percentage of the fine particle carrier (not more than 400 mesh) is not more than 20%, preferably not more than 13%. If it is more than 20%, the carrier particles are deposited on the photosensitive drum, and smooth triboelectric charge with the toner is prevented with the result of promoting edge effect. The weight percentage of the fine carrier particles not more than 350 mesh is not more than 30%, preferably not more than 25%, and more preferably not more than 20%. If it is larger than 30%, the rate of the toner charging is remarkably deteriorated, with the result of increased edge effect.

The amount of the coarse carrier particles (not less than 250 mesh) is closely related with the sharpness of the image. If it is not less than 10% by weight, then the scattering of the toner to the non-image portion is increased with the result of a decrease in the resolution of the image or the easy production of a coarse image. For this reason, the weight percentage of the carrier particles of not less than 250 mesh, is not more than 10%, preferably not more than 7%, and more preferably not more than 5%.

The average particle size of the carrier particles is preferably 20–60 μm, and more preferably 30–56 μm. If it is less than 20 μm, then the density of the image is decreased, and/or the carrier deposition on the photosensitive drum is increased due to the charge-up of the toner. If the average particle size is not less than 60 μm, then the reproducibility of fine lines in the copy is deteriorated.

The magnetic property of the carrier particles is significantly influential to the developing property and the conveyance of the developer, and the uniformity or tone gradation of the image is influenced.

In the case where the saturated magnetization is not less than 75 emu/g (by applied magnetic field of 3000 Oersted), the brush constituted by the carrier particles and toner particles on the developing sleeve faced to the electrostatic latent image on the photosensitive drum is tight during the developing operation, with the result of a deteriorated tone gradation or halftone reproducibility. If it is less than 55 emu/g, then the toner and carrier particles are not reliably retained on the developing sleeve, with the result of an increased foggy background and toner scattering. Furthermore, remaining (residual) magnetization and magnetic retentivity of the carrier particles, is too high, and the conveyance of the developer in the developing apparatus is deteriorated, so that thinning of the image or a non-uniform image density in the solid image, are easily produced. For this reason, the remaining magnetization, and the magnetic retentivity of the carrier particles is preferably not more than 10 emu/g (applied magnetic field of 3000 Oersted), not more than 10 Oersted, and more preferably not more than 5 emu/g, not more than 6.0 Oersted, respectively.

The measuring method of the grain size distribution of the carriage is as follows.

1. Approx. 100 g of the carrier particles is measured to the order of 0.1 g.
2. Sieves of 100 mesh, 145 mesh, 200 mesh, 250 mesh, 350 mesh and 400 mesh are overlaid in this order from the top, and are set on a saucer.

The toner is placed on the top sieve, and it is covered.

3. Using a shaking table, the toner is shaken for 15 min. with a horizontal whirling of 285±6 cycles per minute, and a frequency of 150±10 per minute.
4. The weights of the toner powders remaining on the respective sieves are measured to the order of 0.1 g.
5. A calculation is made to obtain the weight percentage to the order of the second decimal fraction, and the results are rounded to the first dismal fraction order according to JIS-Z8401.

The dimension of the frames of the sieves is 200 mm above the sieving surface, and the depth from the top to the sieving surface is 45 mm, and the total weight of the iron particles at the respective sieves, must be larger than 99% of the weight before the test.

The average particle size is determined on the basis of the particle size distribution measured, in accordance with the following:

Average particle size (μ)=1/100×[(100 mesh-on amount)×140+(145 mesh-on amount)×122+(200 mesh-on amount)×90+(250 mesh-on amount)×68+350 mesh-on amount)×52+(400 mesh-on amount)×38+(all mesh-pass amount)×14]

The magnetic properties of the carrier are determined by a BHU-60 magnetization measurement device (available from RIKEN SOKUTEI KABUSHIKI KAISHA).

In the measurement, approx. 1.0 g of the carrier particles is prepared, and is packed into a cell having an inside diameter of 7 mm and a height of 10 mm, and is set in the measuring device.

During the measurement, the applied magnetic field is gradually increased to 3000 Oersted at maximum. Subsequently, the applied magnetic field is decreased to obtain a hysteresis curvature of the material on the recording sheet. From this, the saturated magnetization, remaining magnetization and magnetic retentivity, are determined.

The carrier particles usable with this invention, may be a known material. For example, iron having an oxidized or non-oxidized surface, nickel, copper, zinc, cobalt, manganese, chrome, rare earth metal or another metal, and alloy metal therewith, oxide therewith, or ferrite may be used. Preferably, a ferrite selected from zinc, copper, nickel, or cobalt is used. The manufacturing method is not limited.

The surface of the carrier particle may be coated with resin material. As for the method therefor, the coating material such as resin or the like is dissolved or suspended in a solvent, and it is applied to the carrier particles. In another method, it is simply mixed with the powder of the particles. Other known methods are usable.

The material fixed to the carrier particles is different depending on the material of the toner. For example, a metal complex of tetrafluoroethylene, monochlorotrifluoroethylene polymer, polyvinylidene fluoride, silicone resin, polyester resin, di-t-butylsalicylic acid, styrene resin, acrylic resin, polyamide, polyvinylbutyral, nigrosine, aminoacrylate resin, basic dye or its lake, silica fine particles, alumina fine particles may be used. They may be used alone or in combination. However, the above are examples and are not limiting.

The amount of the above material is properly determined by one skilled in the art in order that the carrier particles satisfy the above-described conditions. Generally, however, the total weight thereof is preferably 0.1–30% by weight on the basis of the carrier, more preferably 0.5–20%

In this embodiment, the particularly preferable material is ternary ferrite (Cu-Zn-Fe), for example ferrite carrier particles having surfaces coated with 0.001–5% by weight, preferably 0.1–1% by weight of a combination of the fluorine resin materials and styrene resin materials, for example, polyvinylidene fluoride resin and styrene-methyl methacrylate resin; polytetrafluoroethylene resin and styrene-methylmethacrylate resin; fluorine copolymer and styrene copolymer with the ratio of 90:10–20:80, preferably 70:30–30:70. Examples of a fluorine copolymer include vinylidene fluoride-tetrafluoroethylene copolymer (10:90–90:10). Examples of a styrene copolymer include styrene-acrylate 2-ethylhexyl (20:80–80:20), and styrene-acrylate 2-ethylhexyl-methacrylate methyl (20–60:5–30:10–50).

As for the binder resin for the toner, all known materials are usable. The following are examples thereof: styrene resins and derivatives such as styrene, α-methylstyrene, p-chlorostyrene; monocarbonic acid and derivatives having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, methacrylonitrile, diethylaminoethyl methacrylate, diethylaminoethyl methacrylate, acryloamide; dicarbonic acid and derivatives having a double bond such as maleic acid, butyl maleate, methyl maleate, dimethyl maleate; a polymer or copolymer of one or more of vinyl monomers, such as vinyl resin, including vinyl chloride, vinyl acetate, vinyl benzoate, vinylester resin, vinylether resin, such as vinyl ethyl ether, vinyl methyl ether, vinyl isobutyl ether or the like: styrene-butadiene copolymer, silicone resin, polyester resin, polyurethane resin, polyamide resin, epoxy resin, polyvinyl butyral resin, rosin, modified rosin, terpene resin, phenol resin, aliphatic or alicyclic hydrocarbon resin, aromatic petroleum resin, fluorinated paraffin or the like. The above may be used solely or may be used in combination, In addition, the toner may comprise a charge controlling agent. As an example, for magenta color toner of negative property, anthraquinone magenta dye, or metal chelate of alkylsalicylic acid may be used. For a positive polarity toner, magenta color basic dye, or lake pigment or the like, are usable.

For a developer using the above toner, it is preferable that a charge control agent such as colloidal silica, or a flowability improving agent is added with the ratio of 0.01–5% by weight, preferably 0.1–2% by weight, approximately.

The developer used in this invention will be described in detail.

Carrier particles A–C and toner a–c are prepared, as shown in Table 2.

TABLE 2

| Property | Carrier No. | A | B | C |
|---|---|---|---|---|
| Particle size distribution | Ave. particle size (μm) | 49.2 | 46.6 | 66.0 |
| | +100 mesh (%) | 0 | 0.1 | 0 |
| | ~145 (%) | 0 | 0.1 | 2.3 |
| | ~200 (%) | 0.5 | 0.2 | 19.4 |
| | ~250 (%) | 4.0 | 3.1 | 34.1 |
| | ~350 (%) | 81.4 | 72.3 | 42.5 |
| | ~400 (%) | 6.1 | 11.0 | 0.9 |
| | ~400 (%) | 8.0 | 13.2 | 0.8 |
| Mag. property | Saturated magnetization (emu/g) | 63.0 | 59 | 60.0 |
| | Remaining magnetization (emu/g) | 0 | 5.2 | 0 |
| | Mag. retentivity (Oersted) | 0 | 3.0 | 0 |
| Material | | Cu-Zn ferrite | Cu-Zn ferrite | Cu-Zn ferrite |
| Coating material | | PVDF-PTFE/St-2EHA-MMA | PVDF/St-2HEA | PTFE |

PVDF: Polyvinylidene fluoride, PTFE: Polytetrafluoroethylene, St: styrene, MMA: Methacrylate, 2EHA: 2-Ethylehexylacrylate

| | |
|---|---|
| Toner a: | |
| Styrene-n-butyl methacrylate copolymer | 100% by weight |
| Charge controlling agent | 4.0% by weight |
| Quinacrydone pigment (C.I. Pigment Red 122) | 4.0% by weight |
| Methine dye (C.I. Basic Red 12) | 1.0% by weight |
| Toner b: | |
| Non-saturated polyester resin | 100% by weight |
| Charge controlling agent | 4.0% by weight |
| Quinacrydone pigment (C.I. Pigment Red 202) | 3.5% by weight |
| Methine dye (C.I. Basic Red 14) | 0.5% by weight |
| Toner c: | |
| Styrene resin | 100% by weight |
| Charge controlling agent | 4.0% by weight |
| Quinacrydone pigment (C.I. Pigment Red 122) | 4.0% by weight |

The toners a, b and c are produced in the following manner. The materials are melted and kneaded by a rolling mill. After cooling, the material is pulverized by a jet mill, and the pulverized materials are classified. Finally, classified material having average an particle size of 8–10 μm are provided. To the provided material, 0.5% by weight of hydrophobic silica (R-972, available from Japan Aerosil, Kabushiki Kaisha) by is added a Henchel mixer to provide the toner of this invention. In addition, the toner and carrier particles are mixed into a developer with toner density of 6%.

Figure 2:
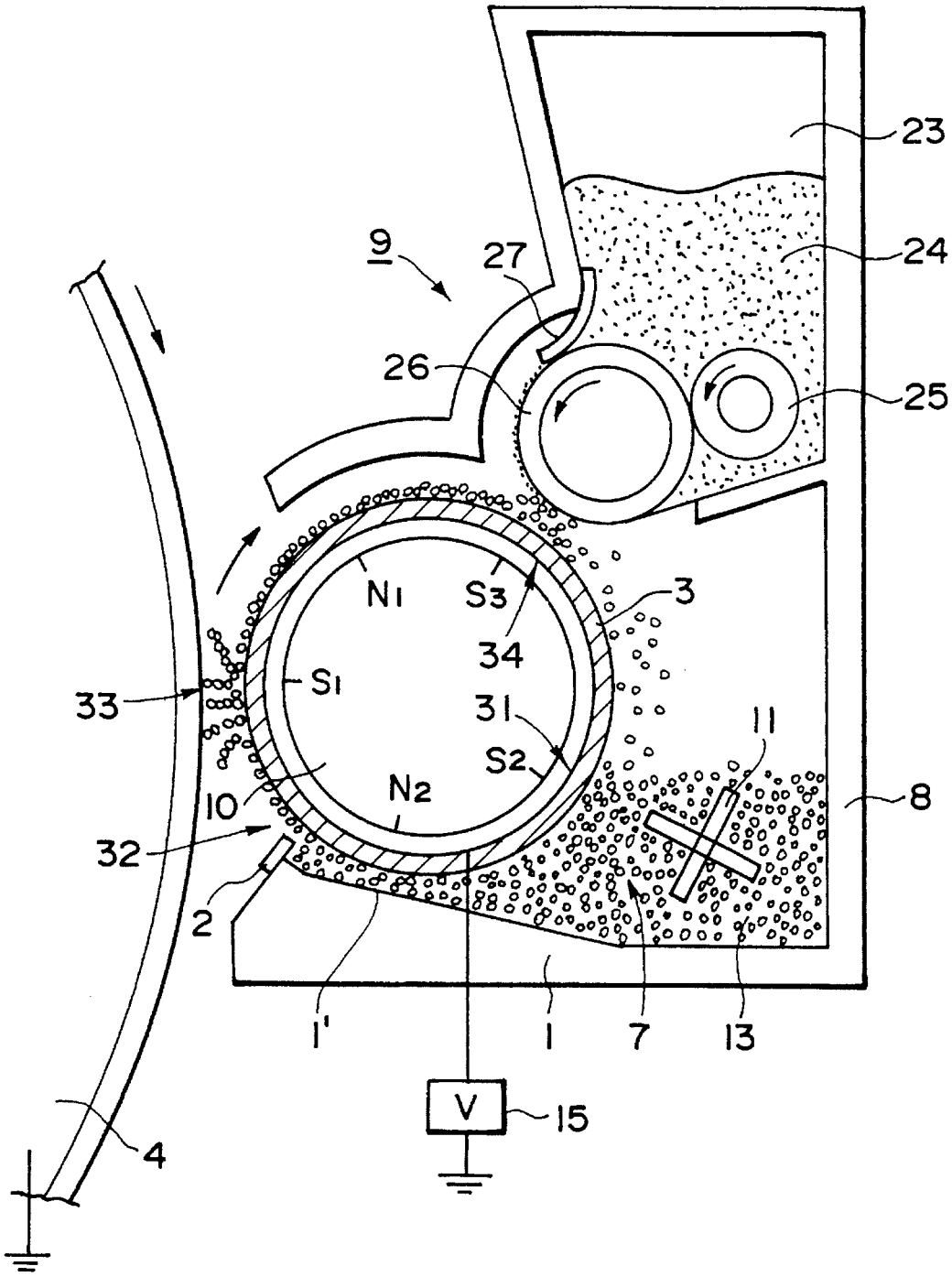
FIG. 2 is an illustration of an example of another developing device usable with the present invention.

The developers A+a, B+b, and A+c are prepared. The evaluations are shown in Table 1 for developing devices (a)–(r). In the case of the combination of the developer C+a, the total evaluation is unsatisfactory for all of the developing devices (a)–(r). In the case of FIG. 2 example, as contrasted to the example of FIG. 1, the rotational direction of the sleeve 3 at the developing position 33 is opposite that of the photosensitive member 4. The present invention is applicable to such a developing device.

In FIG. 2, the magnetic pole S1 functions as a developing pole, and the magnetic pole N1 functions as a magnetic pole for conveying the developer from the developing position 33 to the removing position 34.

In the device of FIG. 2, the toner is supplied to the developer on the sleeve 3 at the removing position 34.

In other words, the toner 24 in the toner container 23 is supplied to a supplying roller 26 by an application roller 25. The toner layer thickness on the supplying roller 26, is regulated by a blade 27. The supplying roller 26 is in contact with the developer layer on the sleeve 3. With the rotation of the supplying roller 26, the toner is supplied to the developer layer on the roller 26. The magnetic flux density of the above-described developing magnetic pole (first pole) is not less than 750, and not more than 1400 Gauss, preferably.

Figure 3:
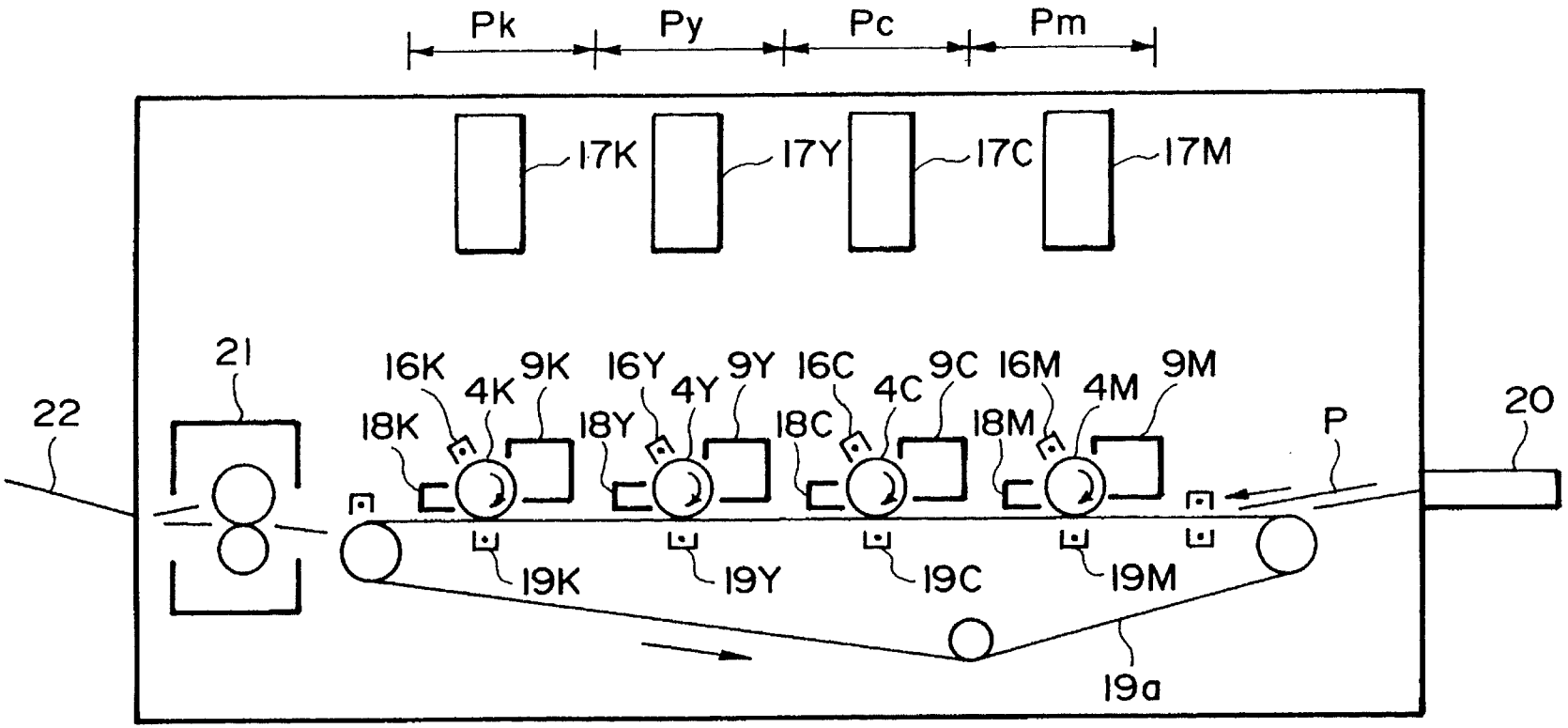
FIG. 3 is an illustration of an example of an image formation device usable with a developing device of the present invention.

If the magnetic flux density of the developing pole is smaller than 750 Gauss, the reproducibility of the image for the low density region is decreased, and if it is larger than 1400 Gauss, the developed image involves non-uniformity stripes, FIG. 3 shows an example of an electrophotographic apparatus capable of using the developing device of this embodiment, in the form of a color printer.

The printer comprises four image forming stations, corresponding to respective colors, each comprising a photosensitive drum and image forming means therearound. The toner images formed on the respective photosensitive drums in the image forming stations, are transferred onto a transfer material carried on a belt-like carrying member, in faced relation with the photosensitive drums, so that a color image is formed.

In each of the image forming stations Pm, Pc, Py and Pk for magenta, cyan, yellow and black colors, photosensitive drums 4 (4M, 4C, 4Y, 4K) are rotatable in a direction indicated by an arrow (clockwise direction). Around each of the photosensitive drums 4M, 4C, 4Y or 4K, a respective corona charger 16 (16M, 16C, 16Y, 16K), scanning optical system 17 as optical scanning means (17M, 17C, 17Y, 17K), developing device 9 (9M, 9C, 9Y, 9K), and a cleaning device 18 (18M, 18C, 18Y, 18K), are disposed.

A transfer station constituting part of the image forming means comprises a respective transfer charger 19 (19M, 19C, 19Y, 19K) for the associated drum, and a transfer belt **19*a* common for the image forming stations. The formation of a full-color image is carried out by transferring and overlaying the respective color toner images sequentially from the photosensitive drums onto the transfer material supported on the transfer belt 19*a*. The transfer material P is supplied from a sheet feeding cassette 20, and the transfer material P after the transfer operation, is separated, and is discharged to a tray 22 through a fixing device 21**.

The scanning optical system 17M, 17C, 17Y and 17K, comprises a laser source not shown, a polygonal mirror for scanningly deflecting the laser beam from the laser source, an f-θ lens focusing on a generating line on the surface of the photosensitive drum the scanning beam, a reflection mirror for deflecting the beam, and a beam detector for detecting a predetermined position of the scanning beam.

In the foregoing, a description has been made as to a so-called contact type developing device for contacting the developer layer on the developer carrying member to the image bearing member.

However, the present invention is applicable to a so-called non-contact type developing device in which the minimum gap between the developer carrying member and the image bearing member is smaller than the layer thickness of the developer.

While the invention has been described with reference to the structures disclosed herein, it is not confined to the details set forth and this application is intended to cover such modifications or changes as may come within the purposes of the improvements or the scope of the following claims.

What is claimed is:

1. A developing device for developing an electrostatic latent image, comprising:

a rotatable developer carrying member for carrying a developer comprising toner particles and magnetic carrier particles, wherein said developer carrying member sequentially rotates through a supply position where the developer is supplied to a surface of said developer carrying member, a regulating position where a regulating member is disposed for regulating a thickness of a layer of the developer on the surface, a developing position where an electrostatic latent image is developed, and a removing position for removing developer remaining on the surface after a developing operation; and a stationary magnet disposed in said developer carrying member, said magnet comprising a developing magnetic pole for forming a magnetic field at the developing position, and a plurality of conveying magnetic poles disposed between the supply position and the regulating position, wherein a peak of magnetic flux density of each of said conveying magnetic poles is 10–49% of a peak of the magnetic flux density of said developing magnetic pole, and wherein the carrier particles have an average particle size of 20–60 μm, and the carrier particles contain 20% or less by weight of carrier particles having sizes not more than 400 mesh, 30% or less by weight of carrier particles having sizes of not more than 350 mesh, 10% or less by weight of carrier particles having sizes not less than 250 mesh, a saturated magnetization of carrier particles is not less than 55 emu/g and not more than 75 emu/g for an applied magnetic field of 3000 Oersted, a residual magnetization of the carrier particles is not more than 10 emu/g for an applied magnetic field of 3000 Oersted, and a magnetic retentivity is not more than 10 Oersted for an applied magnetic field of 3000 Oersted.

2. An apparatus according to claim 1, wherein a magnetic flux density peak of said developing magnetic pole is 750–1400 Gauss.

3. A developing apparatus for developing an electrostatic latent image, comprising:

a developer stirring chamber having a stirring member for stirring developer comprising toner particles and magnetic carrier particles;

a rotatable developer carrying member for carrying a developer, wherein said developer carrying member is sequentially rotatable through a regulating position where a regulating member is disposed for regulating a thickness of a layer of the developer formed on a surface of said developer carrying member, a developing position for developing an electrostatic latent image, and a removing position for removing developer remaining on the surface after a developing operation; and a stationary magnet disposed in the developer carrying member, wherein said magnet comprises a first magnetic pole for forming a magnetic field at the developing position, a second magnetic pole for magnetically attracting developer in said stirring chamber to the surface of the developer carrying member at a position between said removing position and said regulating position, and a third magnetic pole disposed downstream of the second magnetic pole and upstream of said regulating position with respect to a rotational direction of said developer carrying member to form a magnetic field at the regulating position;

wherein a peak of magnetic flux density of each of said second magnetic pole and said third magnetic pole is within 10–49% of a peak of the magnetic flux density of the first magnetic pole; and wherein the carrier particles have an average particle size of 20–60 μm, and the carrier particles contain 20% or less by weight of carrier particles having sizes not more than 400 mesh, 30% or less by weight of carrier particles having sizes of not more than 350 mesh, 10% or less by weight of carrier particles having sizes not less than 250 mesh, a saturated magnetization of carrier particles is not less than 55 emu/g and not more than 75 emu/g for an applied magnetic field of 3000 Oersted, a residual magnetization of the carrier particles is not more than 10 emu/g for an applied magnetic field of 3000 Oersted, and a magnetic retentivity in not more than 10 Oersted for an applied magnetic field of 3000 Oersted.

4. An apparatus according to claim 3, wherein a magnetic flux density peak of said developing magnetic pole is 750–1400 Gauss.

5. An apparatus according to claim 4, wherein said magnet further comprises a fourth magnetic pole disposed upstream of said second magnetic pole with respect to a rotational direction of said developer carrying member, said fourth magnetic pole being adjacent to said second magnetic pole, and having the same polarity as the second magnetic pole, thus forming a repelling magnetic field therebetween, by which developer is removed from the developer carrying member at the removing position.

* * * * *

UNITED STATES PATENT AND TRADEMARK OFFICE

CERTIFICATE OF CORRECTION

PATENT NO. : 5,525,752

DATED : June 11, 1996

INVENTOR(S) : Masami IZUMIZAKI, et al.

It is certified that error appears in the above-indentified patent and that said Letters Patent is hereby corrected as shown below:

COLUMN 1:

Line 38, "is" should read --are--.

COLUMN 3:

Line 44, "provide" should read -- provide a--.

COLUMN 4:

Table 1, "Converying" should read --Conveying--.

COLUMN 8:

Table 2, "PVDF/St-2HEA" should read --PVDF/St-2EHA--; and "2-Ethylehexylacrylate" should read --2-Ethylhexylacrylate--.

COLUMN 9:

Line 8, "by is added" should read --is added by--.

COLUMN 12:

Line 13, "in" should read --is--.

UNITED STATES PATENT AND TRADEMARK OFFICE

CERTIFICATE OF CORRECTION

PATENT NO. : 5,525,752

DATED : June 11, 1996

INVENTOR(S) : Masami IZUMIZAKI, et al.

It is certified that error appears in the above-indentified patent and that said Letters Patent is hereby corrected as shown below:

COLUMN 12:

Line 13, "in" should read --is--.

Signed and Sealed this

Twenty-sixth Day of November 1996

*Attest:*

Bruce Lehman

BRUCE LEHMAN

*Attesting Officer*

*Commissioner of Patents and Trademarks*